US005640711A

United States Patent [19]

Lefort et al.

[11] Patent Number: 5,640,711

[45] Date of Patent: Jun. 24, 1997

[54] HEAD-MOUNTED VISOR WITH VARIABLE TRANSMISSION

[75] Inventors: Yves Lefort, Pessac; Gérard Le Paih, Merignac, both of France

[73] Assignee: Sextant Avionique, Meudon La Foret, France

[21] Appl. No.: 348,121

[22] Filed: Nov. 28, 1994

[30] Foreign Application Priority Data

Dec. 10, 1993 [FR] France ..... 93 14870

[51] Int. Cl.[6] ..... A61F 9/04; G02C 7/10; G02B 5/23

[52] U.S. Cl. ..... 2/6.3; 2/432; 351/165

[58] Field of Search ..... 2/6.3, 6.4, 6.5, 2/6.7, 432; 359/84, 85, 90, 91, 94; 434/36; 351/162, 165

[56] References Cited

U.S. PATENT DOCUMENTS 2,815,508 12/1957 Finken .
4,080,051 3/1978 Krohn et al. ..... 351/165
4,482,326 11/1984 Witt ..... 434/36

FOREIGN PATENT DOCUMENTS

099524A3 2/1984 European Pat. Off. .
2394261 6/1977 France .
4-245904 2/1992 Japan .
4106019A1 10/1991 Netherlands .

*Primary Examiner*—Peter Nerbun
*Attorney, Agent, or Firm*—Oblon, Spivak, McClelland, Maier & Neustadt, P.C.

[57] ABSTRACT

A head-mounted visor with variable transmission has at least two zones with different values of absorption of light. Should the visor be mounted on a pilot's helmet, an upper zone designed for looking at the exterior of the aircraft absorbs more light than a lower zone designed for looking at the dashboard instruments. The application is directed to helmet equipment for tasks comprising swift passages from a very bright space to a darkened space.

10 Claims, 2 Drawing Sheets

HEAD-MOUNTED VISOR WITH VARIABLE TRANSMISSION

BACKGROUND OF THE INVENTION

1. Field of the Invention

The present invention relates to a head-mounted visor with variable light transmission. It can be applied notably to helmet-mounted systems for aircraft pilots. More generally it can be applied to protection systems which need to be freed from the constraints of slow variation in transmission, notably due to the absorbent element constituted by photochromic agents.

A helmet-mounted visor for an aircraft pilot generally has two essential protective functions. A first protective function is that of protecting the face against external mechanical forces. This protection is usually provided by an often cylindrical or spherical plate made of transparent thermoplastic material, polycarbonate for example.

A second protective function is that of protecting the eyes against solar radiation, the visor being capable of getting shaded or lightened and hence of absorbing different amounts of light energy in a reversible way, as a function of the ambient luminosity, through the presence of chemical substances integrated into the thickness or surface of the visor. These substances causing variation, as a function of the luminosity, in the coloring of the material that they integrate are called photochromic substances.

More particularly, these photochromic substances are constituted by molecules whose structure gets modified reversibly under the effect of photons that they receive, this modification giving rise to a change in color. Known photochromic substances in use are the groups of substances known as spiropyranes or spiroxazines.

2. Description of the Prior Art

There exist variable transmission visors formed by a transparent thermoplastic plate, the photochromic substance being incorporated during the injection of the part or deposited on the surface by a gun or by molding for example. These visors absorb a part of the incident light energy identically at every point on the visor.

A plastic based on photochromic substances may, in its clear state, provide for transmission of light of about 75% to 85%. In the presence of high luminosity, the plastic attains a darkened state and the transmission may drop to values of 20% to 30% for example. The levels of transmission in the clear state and in the darkened state depend on the nature of the photochromic substances used or on the composition of the mixture of these substances. These levels of transmission also depend on the respective concentrations of photochromic substances in the thickness or on the surface of the visor. At ambient temperature, the reaction times of the photochromic substances are generally lengthy. These reaction times are equal to about one minute for darkening and several minutes for illumination.

For certain required functions, these reaction times are too slow. In particular, to provide ocular protection for pilots against solar radiation, these performance characteristics are quite insufficient for certain types of aircraft.

A pilot needs a clear visor when the luminosity is low and a darkened visor when he encounters conditions of intense illumination, when he passes over the cloud layer for example. A standard photochromic visor as defined here above poorly meets the pilot's requirements. It is in general excessively clear or excessively darkened because of the above-mentioned excessively lengthy reaction times inherent in the very nature of the photochromic substances: it is notably the change from the darkened state to the clear state that occurs with far too great a delay. This has the consequence of troubling the pilot's vision and hence of reducing his safety.

There are of course known ways of using LCD (liquid-crystal display) type solutions wherein the reaction times are short. However, these solutions, which can be well integrated with glass are very difficult to integrate with plastics such as those used in visors.

SUMMARY OF THE INVENTION

The aim of the invention is to overcome the above mentioned drawbacks, notably by proposing a visor architecture suited to the work carried out by the wearer of the visor, for example an aircraft pilot, this architecture making it possible to free the wearer from the constraints of the above-mentioned reaction times.

To this end, an object of the invention is a head-mounted visor with variable light transmission wherein the visor has at least two different light absorption zones, each zone being dedicated to a zone of the external space scanned by the pilot's gaze.

The main advantages of the invention are that it improves the safety and viewing comfort of the wearer of the visor, enables a heightening of the contrast of the image projected inside the visor in the case of helmet visual displays with the projection of symbols on the visor, thus improving the readability of the information elements, and is economical and easy to implement.

BRIEF DESCRIPTION OF THE DRAWINGS

Other features and advantages of the invention shall appear from the following description, made with reference to the appended drawings, of which.

MORE DETAILED DESCRIPTION

Figure 1:
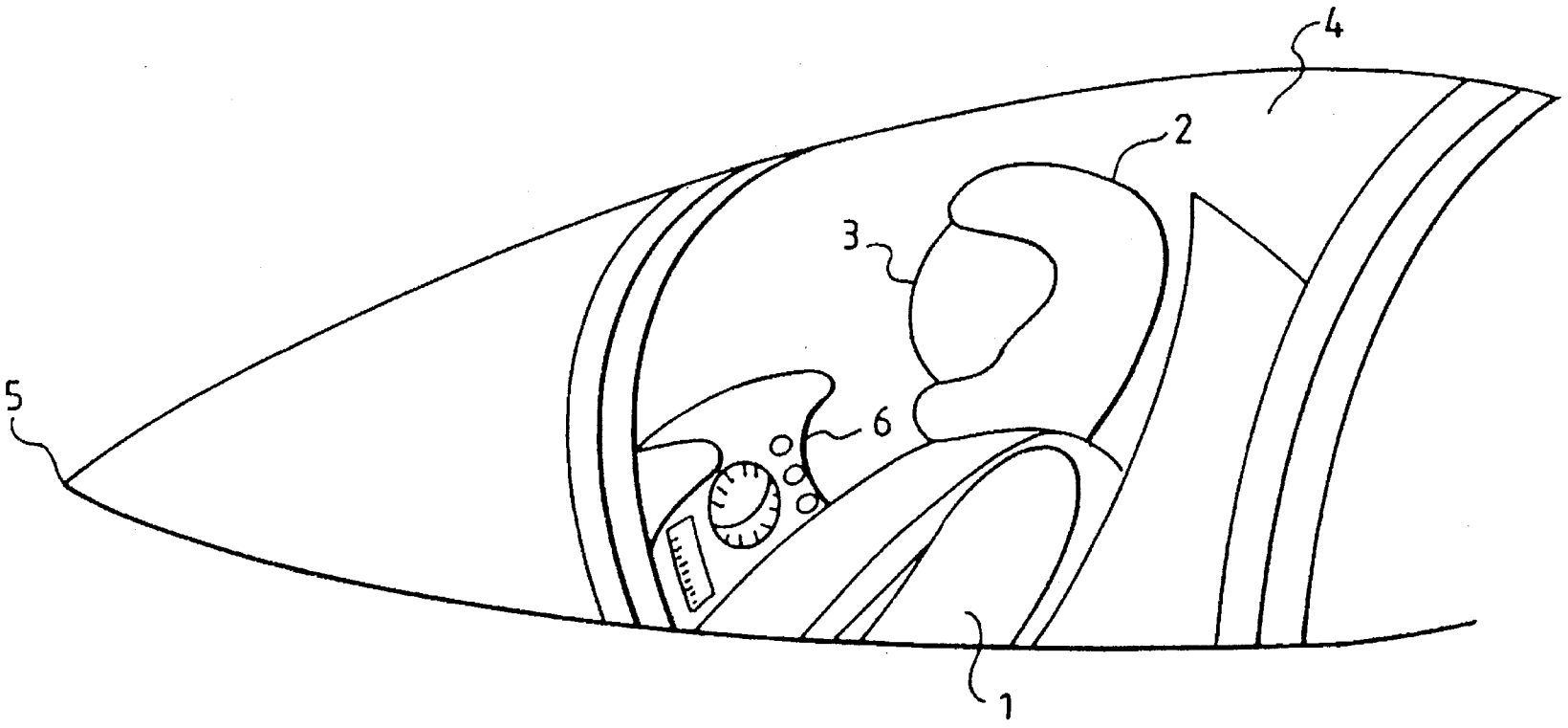
FIG. 1 shows a pilot wearing a helmet with a mounted visor.

FIG. 1 shows an exemplary view of a pilot 1 wearing a helmet 2 with a mounted visor 3. The pilot is, for example, in the cockpit 4 of an aircraft 5, only the front part of which is shown. To fulfil his task properly, the pilot should be capable of looking out of the aircraft and at the dashboard instruments 6 with the greatest possible comfort. In particular, he should not be hampered by intense light rays.

The reaction times for the changing to darkened conditions or conditions of illumination being given, the structure of the visor according to the invention uses the fact that the parts of the visor are not all functionally identical. The visor according to the invention then advantageously has two different light absorption zones, the zone with higher absorption corresponding to the part of the wearer's visual field, namely the outside scene, that requires a less clear perception than the part with lower absorption. Should the wearer be an aircraft pilot, the former part corresponds for example to the view of the exterior of the aircraft and the latter part to the view of the dashboard instruments. To improve the efficiency of the visor, the transition speeds are different from one zone to the other, i.e. the reaction speeds of the photochromic substances or of the LCD materials are different from one zone to the other. The variation of the transmission is then slower or faster from one zone to the other. In the example of an application to an aircraft pilot, it would be advantageous for the transition speed of the zone assigned to the dashboard instruments to be as high as possible. The variable transmission may be obtained by an association of the photochromic and LCD technologies, making it possible to obtain transition speeds that are different from one zone to the other.

Figure 2:
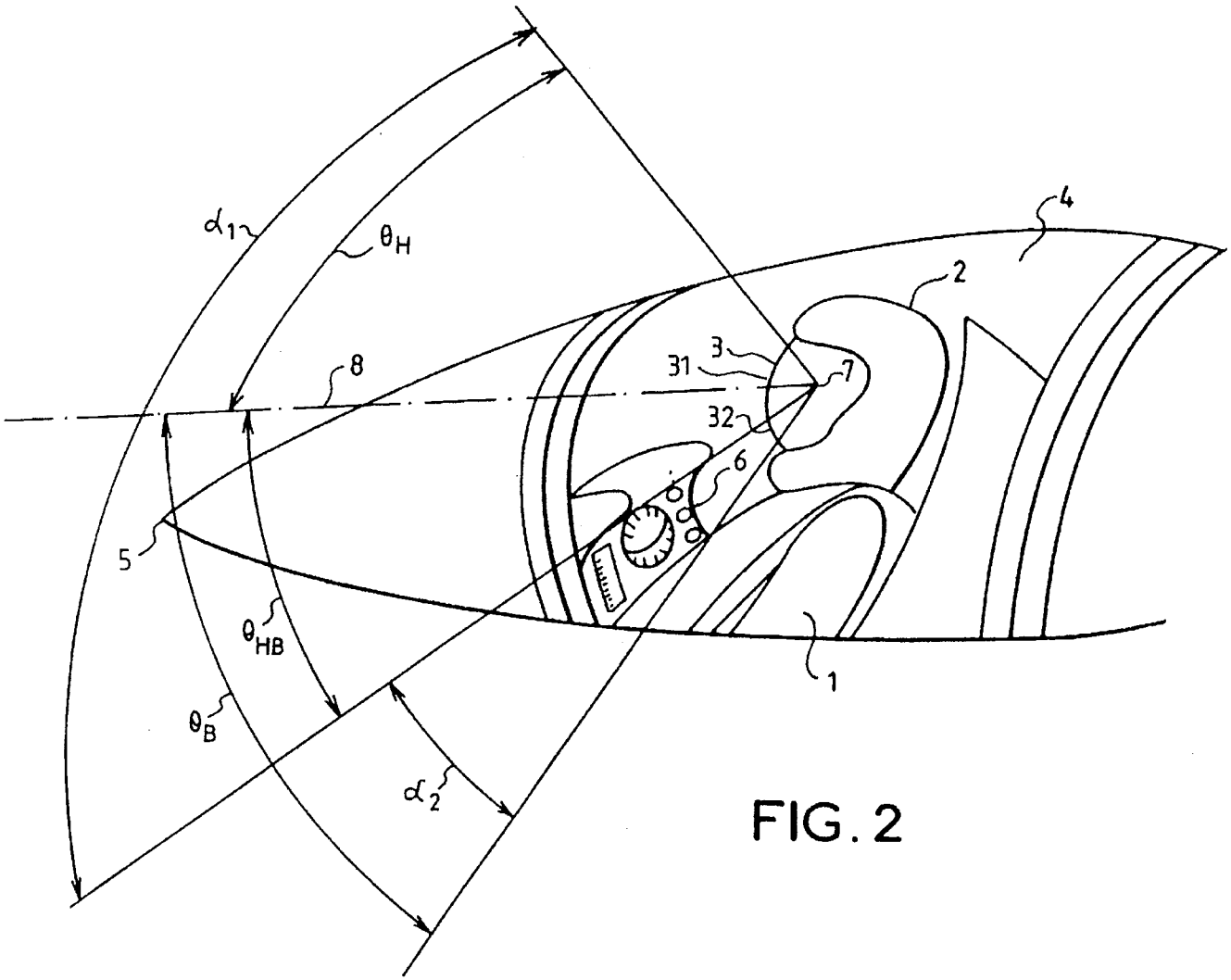
FIG. 2 shows a principle of the structure of the visor according to the invention.

FIG. 2 illustrates a principle of the structure of a visor according to the invention, with which pilot shown in FIG. 1 is equipped.

By way of an example, the visor 3 according to the invention is divided into two zones 31, 32 corresponding to vertical angles of vision $\alpha_1$ and $\alpha_2$ scanned by the gaze of the pilot 1 and having their point of origin at the eye 7 of the pilot 1 for example. The direction chosen as the original direction for the pilot's gaze is, for example, the direction 8 seen by the eye 7 when it is at rest. The upper zone 31 of the visor corresponds to an angle $\alpha_1$ ranging from a first angle $\Theta_H$ to a second angle $\Theta_{HB}$ taken with respect to the original direction 8 and the lower zone 32 corresponds to an angle $\alpha_2$ ranging from the second angle $\Theta_{HB}$ to a third angle $\Theta_B$ taken with respect to the original direction 8. The original direction 8 corresponds to a zero angle, the algebraic value of the first angle $\Theta_H$ is greater than the algebraic value of the second angle $\Theta_{HB}$ whose algebraic value is greater than that of the third angle $\Theta_B$. For example, $\Theta_H$ may be equal to +70°, $\Theta_{HB}$ to −25° and $\Theta_B$ to −35°. This means that, in this case, the upper zone 31 of the visor 3 corresponds to an angle of vision ranging from +70° above and −25° below the original direction 8 and that the low zone 32 of the visor 3 corresponds to an angle of vision ranging from −25° to −35° below the original direction 8.

The upper zone 31 is used, for example, essentially for looking outside the aircraft. This part ensures notably high protection against solar radiation. For safety reasons, the lower zone 32 should, for example, remain clearer than the upper zone 31 even in the event of intense light radiation. Indeed, the pilot needs to consult his dashboard instruments in all circumstances, but especially so when he passes from a sunlit space to a dark space where the visibility gets reduced. It is then the lower zone 32 of the visor that is brought into play. The pilot also needs a good perception of colors in order to read the symbols on the screens and other dashboard 6 indicators. It would therefore detrimental to the pilot if excessive reaction times for the change-over to illumination of the visor were to disturb his reading of the dashboard instruments.

The photochromic substances and their concentration are then chosen for example in such a way to as to promote high absorption in the upper zone 31 of the visor. The range of transmission of this zone may vary, for example, between 75% and 20%, from the clear state to the darkened state.

It must be noted that in the case of helmet visuals with the projection of symbols on the visor 3, the invention has an additional advantage for it enables an increase in the contrast of the image projected inside the visor 3 on its upper zone 31. The readability of the information elements is thus greatly heightened.

With regard to the lower zone 32 of the visor 3, the choice of the photochromic substances is, for example, such that this zone absorbs less light than the high zone 31 and that its range of transmission of light is small as compared with this high zone. The range of transmission of the low zone may vary, for example, between 85% and 40% from the clear state to the dark state. The photochromic substances of the low zone 32 are, for example, also chosen so as to increase the reaction speeds and obtain an attenuation of the colors throughout the visible spectrum that is as neutral as possible in order to promote efficient perception of the dashboard indicators and display cathode-ray screens for example.

The absorption means used in the visor according to the invention may, for example, be photochromic substances as described here above, or again any other type of absorbent.

The visor may be divided into more than two zones. Thus, for example, in addition to the above-described two zones, there could be a zone dedicated to the reading of specific indicators such as, for example, a head-up display panel requiring notably efficient appreciation of the color of certain symbols.

The arrangement of the zones may be such that they are distributed not only from top to bottom but also, for example, from right to left notably when, on top of the constraints of reaction times, there are also problems relating to the appreciation of colors or shapes in well-defined spatial zones surrounding the pilot.

The application of the visor has been present for an airplane pilot. However, it could be used for other applications, notably for the pilots of all types of aircraft.

What is claimed is:

1. A head-mounted visor with variable light transmission worn by an operator, wherein the visor has at least two different light absorption zones, each zone being dedicated to a zone of the external space scanned by the operators line of sight, wherein one of said at least two different light zones is an upper zone having a first light absorption range and another one of said two different light zones is a lower zone having a second light absorption range different than the first range wherein the upper zone has a capacity for absorbing more light than the lower zone, and wherein the lower zone has a transition speed which is higher than a transition speed of the upper zone.

2. A visor according to claim 1, wherein the lower zone has a range of transmission making it possible to obtain higher levels of transmission than in the upper part.

3. A visor according to claim 1 wherein, the visor is used by an aircraft pilot and the upper zone is used for looking at the exterior of the aircraft.

4. A visor according to claim 1 wherein, the visor is used by an aircraft pilot and the lower zone is used for looking at the dashboard instruments of the aircraft.

5. A visor according to claim 1, wherein the zone of highest absorption has a range of transmission of 75% to 20%.

6. A visor according to claim 1 wherein the zone of lowest absorption has a range of transmission of 85% to 40%.

7. A visor according to claim 1 wherein, with the visor comprising photochromic substances, the zones of the visor comprise different concentrations of photochromic substances.

8. A visor according to claim 1 wherein, with the visor comprising photochromic substances, the zones of the visor comprising different photochromic substances.

9. A visor according to claim 1, wherein the function of variable transmission is fulfilled by an LCD material.

10. A visor according to claim 1, wherein the variable transmission is provided by an association of photochromic and LCD technologies making it possible to obtain transition speeds that are different from one zone to the other.

* * * * *